US005725237A

United States Patent [19]

Krafft et al.

[11] Patent Number: 5,725,237

[45] Date of Patent: Mar. 10, 1998

[54] SKI HAVING A SOLE STRUCTURED IN ACCORDANCE WITH THE DISTRIBUTION OF PRESSURE ALONG THE SKI

[75] Inventors: Bertrand Krafft, Aix Les Bains; Gilles Silva, Le Montcel; Jacques Le Masson, Cran Gevrier, all of France

[73] Assignee: Salomon S.A., Metz-Tessy, France

[21] Appl. No.: 348,862

[22] Filed: Nov. 28, 1994

[30] Foreign Application Priority Data

Dec. 9, 1993 [FR] France ..... 93 15019

[51] Int. Cl.[6] ..... A63C 5/04

[52] U.S. Cl. ..... 280/609; 280/610

[58] Field of Search ..... 280/609, 608, 280/610, 601, 604, 28

[56] References Cited

U.S. PATENT DOCUMENTS

| | | | |
|---|---|---|---|
| 3,378,274 | 4/1968 | Poppen | 280/609 |
| 4,118,050 | 10/1978 | Schnurrenberger | 280/604 |
| 4,223,909 | 9/1980 | Danner et al. | 280/604 |
| 4,268,059 | 5/1981 | Staufer | 280/604 |
| 4,359,077 | 11/1982 | Staufer | 144/371 |
| 4,406,478 | 9/1983 | Staufer | 280/604 |
| 4,509,771 | 4/1985 | Nussbaumer | 280/609 |
| 4,714,266 | 12/1987 | Feichtlbauer | 280/604 |
| 4,919,447 | 4/1990 | Jackson et al. | 280/609 |
| 5,328,200 | 7/1994 | Pelizzari | 280/609 |

FOREIGN PATENT DOCUMENTS

| | | | |
|---|---|---|---|
| 1102116 | 10/1955 | France . | |
| 2314739 | 1/1977 | France . | |
| 2431356 | 2/1980 | France . | |
| 2654005 | 5/1991 | France . | |
| 2683730 | 5/1993 | France . | |
| 182997 | 1/1955 | Germany | 280/609 |
| 961335 | 10/1956 | Germany . | |
| 3624597 | 2/1987 | Germany . | |
| 4022286 | 2/1991 | Germany . | |
| 4033235 | 5/1991 | Germany | 280/609 |
| 161592 | 7/1933 | Switzerland . | |
| 331559 | 9/1958 | Switzerland . | |

*Primary Examiner*—Brian L. Johnson
*Assistant Examiner*—Min Yu
*Attorney, Agent, or Firm*—Greenblum & Bernstein, P.L.C.

[57] ABSTRACT

A ski having a sole equipped with discontinuous serrations comprising a smooth or lightly structured front portion and a strongly structured rear portion. The rear portion extends towards the rear in the direction of rear contact line from a transverse line located between the boot center line and a transverse line located at a distance (d) from the boot center line, equal to 0.4 times the distance (D) separating the line from forward contact line. The invention is more specifically related to an alpine ski whose ability to glide is thus improved.

42 Claims, 4 Drawing Sheets

1
2
3
4
5
6
10
11
12
13
D
α
L
50
60

SKI HAVING A SOLE STRUCTURED IN ACCORDANCE WITH THE DISTRIBUTION OF PRESSURE ALONG THE SKI

BACKGROUND OF THE INVENTION

FIELD OF THE INVENTION

The invention is related to a snow ski, such as an alpine ski, a monoski or a snowboard.

More specifically, it is related to a ski having a lower sole equipped with serrations whose gliding ability has been improved.

DISCUSSION OF THE BACKGROUND AND MATERIAL INFORMATION

Specialists in the field of skis recognize that the sole that is in contact with the snow should not remain completely smooth in order to obtain a correct gliding of the ski. Due to the effect of friction and the pressure that is exerted, grains of snow melt and get transformed into micro-droplets that have a tendency to get packed and to form a film of lubricating water. A serrated structuring of the sole thus contributes to breaking such film and enabling its removal so as to avoid suction phenomena that resist gliding.

This awareness has resulted in the disclosure of a certain number of patents presenting more or less empirical solutions in response to the problems raised by such phenomena.

In French Patent Publication 1,102,116 and Swiss Patent Publication Nos. 161,592 and 331,559, the sole is equipped with a series of continuous and parallel grooves that extend over a large portion of the length of the ski. The disadvantage is that one obtains an extremely directional ski with which it becomes very difficult to take turns at high speeds. To overcome this, it was thought to shorten the length of the grooves and to regroup them into rows separated from one another as in French Patent Publication No. 2,654,005. In this solution, the surface structure reunites, on the one hand, an adequate formation and guidance effect for the water layer, and on the other hand, appropriate breakage of the water layer without providing the ski with a substantial directional effect.

In French Patent Publication No. 2,683,730, the gliding surface is equipped with discontinuous, serrations oriented in the longitudinal direction, that are wavy in shape, having overall sinuous curves, so as to preferably provide the sole with a roughness coefficient Ra that is comprised within an appropriate value range.

German Patent Publication No. 4,022,286 is related to a gliding surface coating wherein polyethylenes having different characteristics are used, polyethylenes having greater hardness being used in the superficial base pressure section. This solution is expensive because it necessitates the use of different materials for the same sole. In addition, in light of the differences in hardness of the materials, the structuring gets worn more quickly in the zone where the polyethylene has less hardness, i.e., at the rear of the ski. The benefits of differentiated roughness are thus quickly lost.

All prior art solutions have mainly concentrated on working on the shape, length and orientation of the structuring without considering which zones ought to receive optimally such a structuring and which zones ought not to get structured, or only lightly structured, and how the structuring should be obtained in each of such zones.

SUMMARY OF THE INVENTION

An object of the invention is to provide a satisfactory solution to these problems.

The Applicants have indeed noted that a gliding surface has zones that are biased differently on the snow, and that consequently, structuring should be done in consideration thereof.

Snow is a three-phase powdery environment made up of a mixture of ice, water and water vapor. The proportion of each phase in the mixture varies progressively during passage of the bearing surface of the ski due to two important parameters, i.e., friction caused by the sole/snow interface and the distribution of pressure along the ski.

FIG. 1 shows a ski on snow when it bears the weight of the skier and FIG. 2 illustrates the shape of the distribution of pressure (P) curve over the length of the ski (L).

This enables one to note that when the ski moves over the snow surface, the pressure exerted tends to increase progressively from a zone located in front of the ski boot; this tends to promote the progressive formation of the film of water from this point.

Numerous tests carried out by the Applicants have enabled one to verify that the performance of the ski was bettered when the structuring of the sole was more pronounced in the rear portion of the ski, than in the front portion. In addition, it was also demonstrated that too much structuring in the front portion had a detrimental effect on the gliding properties of the ski. The Applicants were able to determine by experimentation which structural aspects of the sole surface should be adhered to in accordance with the parameters of pressure distribution and friction so as to obtain a high-performance ski on all types of snow.

For this, the ski as per the invention includes a lower gliding surface made of a plastic material, equipped with a plurality of discontinuous serrations, the surface resting on a front contact line and a rear contact line when the ski does not bear a load and wherein the surface comprises a non-structured or only lightly structured front portion and a more strongly structured rear portion whose measured roughness parameter value Rtm is greater than the value measured in the front portion. The rear portion extends towards the rear of the ski in the direction of the rear contact line, from a transverse line located between the center line of the ski boot, and further, a transverse line located at a distance from the boot center line equal to 0.4 times the distance separating said line from the forward contact line.

In order to define the boundary demarcating the two differently structured sole portions, Applicants elected to refer to the line indicative of the center of the boot on the ski that each manufacturer must indicate in accordance with the standard ISO/DIS8364. Respecting the assembly of the bindings with respect to this line conditions the pressure distribution resulting from the ski and more specifically enables the greater and lesser pressure zones to be identified.

The Rtm parameter designates the average of the maximum roughnesses that measure the vertical distance between the uppermost and the lowermost points of the roughness section over the total evaluation length, as per standard DIN 4762/1E or ISO 4287/1.

Preferably, the Rtm value is less then or equal to 15 μm in the front portion of the gliding surface and is greater than 15 μm in the rear portion of the gliding surface.

According to another characteristic, the rear portion of the strongly structured gliding surface extends rearwardly, at least until the rear contact line of said surface. In this advantageous configuration, the Applicants have noted better performance, due most certainly to a better breakage and removal of the film of water.

According to a preferred embodiment, the rear portion that is subject to a very pronounced structuring starts from a line located at a distance from the boot center line comprised between 0.2 and 0.4 times the distance separating the boot center line from the forward contact line. The start of the strongly structured portion thus begins in a high pressure zone that corresponds generally to a maximum pressure peak located in the vicinity of the front abutment of the binding.

As per a secondary characteristic, the rear portion comprises such a pronounced structuring that the roughness value Rtm is greater than 15 μm along a central width portion (l1) only from width (L) of the sole; said rear portion comprising on either side of said structured central portion, edge widths (l2) that are smooth or less structured and whose measured roughness value Rtm is less than 15 μm and the measured roughness value Rku<3. Indeed, the Applicants have noted that the central portion plays an important role in the flat gliding of the ski and that it is thus important that it be well structured so as to enable a good runoff and avoid the suction phenomenon. On the other hand, while executing turns, the skier bends the ski along one or the other side running edges. The sole thus remains in contact with the snow along a side region having a small width and bordering on the central portion. The pressure exerted by the weight of the skier over this small surface is therefore substantial and it therefore becomes important to reduce friction as much as possible by providing a smooth surface or one where the structuring is less pronounced. In fact, one must give greater importance to the support and gripping properties of the running edges, while reducing the "guiding" effects that are due to the structuring of the sole that could resist turn execution. The problem of the film of water is secondary in this case.

The Rku parameter (Kurtosis Roughness) designates the flattening parameter of the density of height distribution. The flatter the density curve, the greater the Rku; on the other hand, if the curve is pointed and its peak is well centered, the Rku is less (ISO standard 4287/1).

As per a characteristic linked to the previous one, width (l2) of the edges is comprised between 0.03 L and 0.3 L, it being understood that width (l1) of the central portion of the flat gliding should remain greater than or equal to 0.45 L.

Advantageously, the strongly serrated rear portion has a constant width along the lower surface of the ski. Such a structuring can be easily obtained by a repetitive and reproducible technique by passing a hot tool having a constant edge width over the sole, in a single pass.

Thus, as per an advantageous complementary characteristic, the structuring of the rear portion is obtained by the heat passage, under pressure, of a tool, over the lower gliding surface, said tool having the shape of a roller comprising a raised design having a constant edge width on the surface from which is formed a plurality of discontinuous ribs.

According to another, more general characteristic, the strongly structured rear portion comprises a plurality of short serrations, that are rectilinear and discontinuous, and arranged in separate or meshed rows.

According to a complementary characteristic, at least a majority of the serrations are oriented along the longitudinal axis of the ski. Some, however, can be inclined at a certain angle with respect to the longitudinal axis, so as to mainly avoid too much of a "rail" effect or also to improve the disengagement of the film of water under certain snow conditions or for certain types of skis.

It can also be advantageously provided that the structuring, of the rear portion at least, has such a roughness gradient that the value Rtm and Rku decreases progressively, from the rear contact line in the direction of the forward contact line.

Similarly, the structuring can have such a roughness gradient that the values Rtm and Rku increase progressively from the side running edges towards the longitudinal axis over a significant portion, at least, of the width of the lower surface, it being understood that the roughness (Rtm and Rku) can remain substantially constant over small portions.

According to another characteristic of the invention, the gliding surface is constituted by a coating having the same chemical properties and the same hardness over the entire length of the ski. Thus, wear and tear of the structuring takes place homogeneously and at the same time over the entire length of the ski.

BRIEF DESCRIPTION OF THE DRAWINGS

Many other characteristics of the invention will become apparent from the description that follows as per the non-limiting embodiments of a ski as per the invention, with reference to the annexed schematic drawings wherein.

DETAILED DESCRIPTION OF THE PREFERRED EMBODIMENTS

Figure 1:
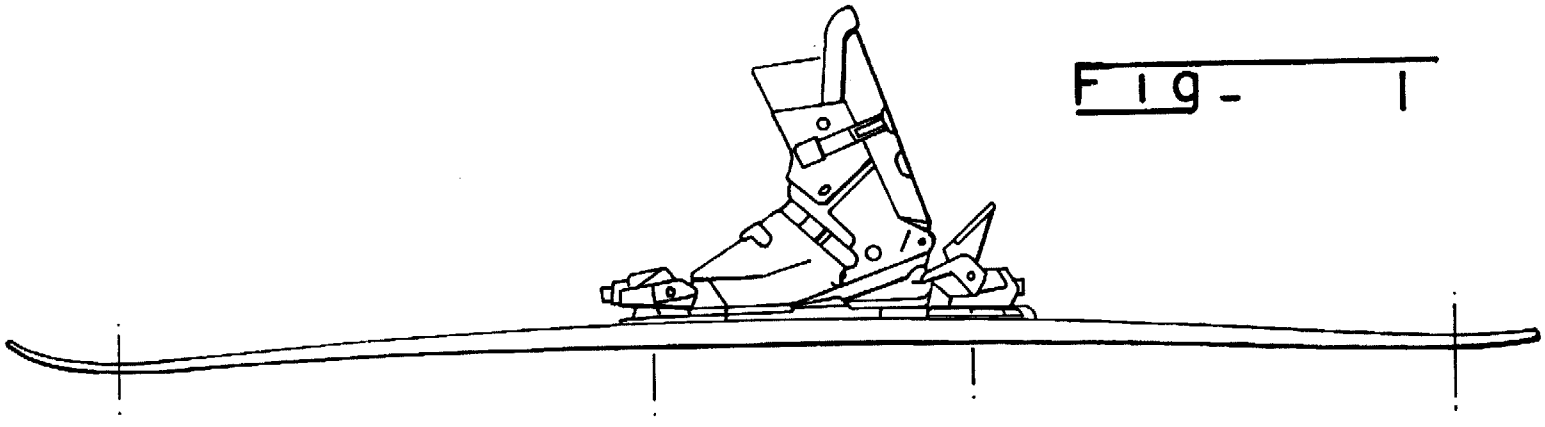
FIG. 1 illustrates a ski on snow when it bears the weight of the skier.
Figure 2:
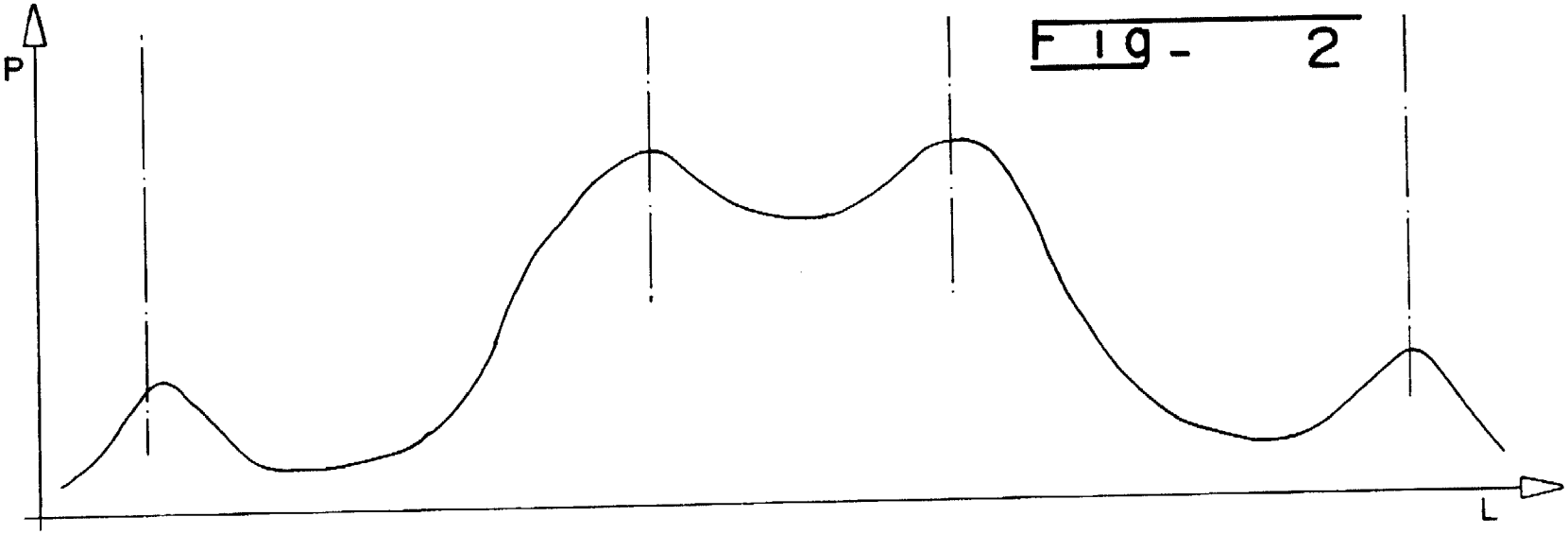
FIG. 2 illustrates the shape of the distribution of pressure (P) curve over the length of the ski (L).
Figures 3, 4, 4A, 4B:
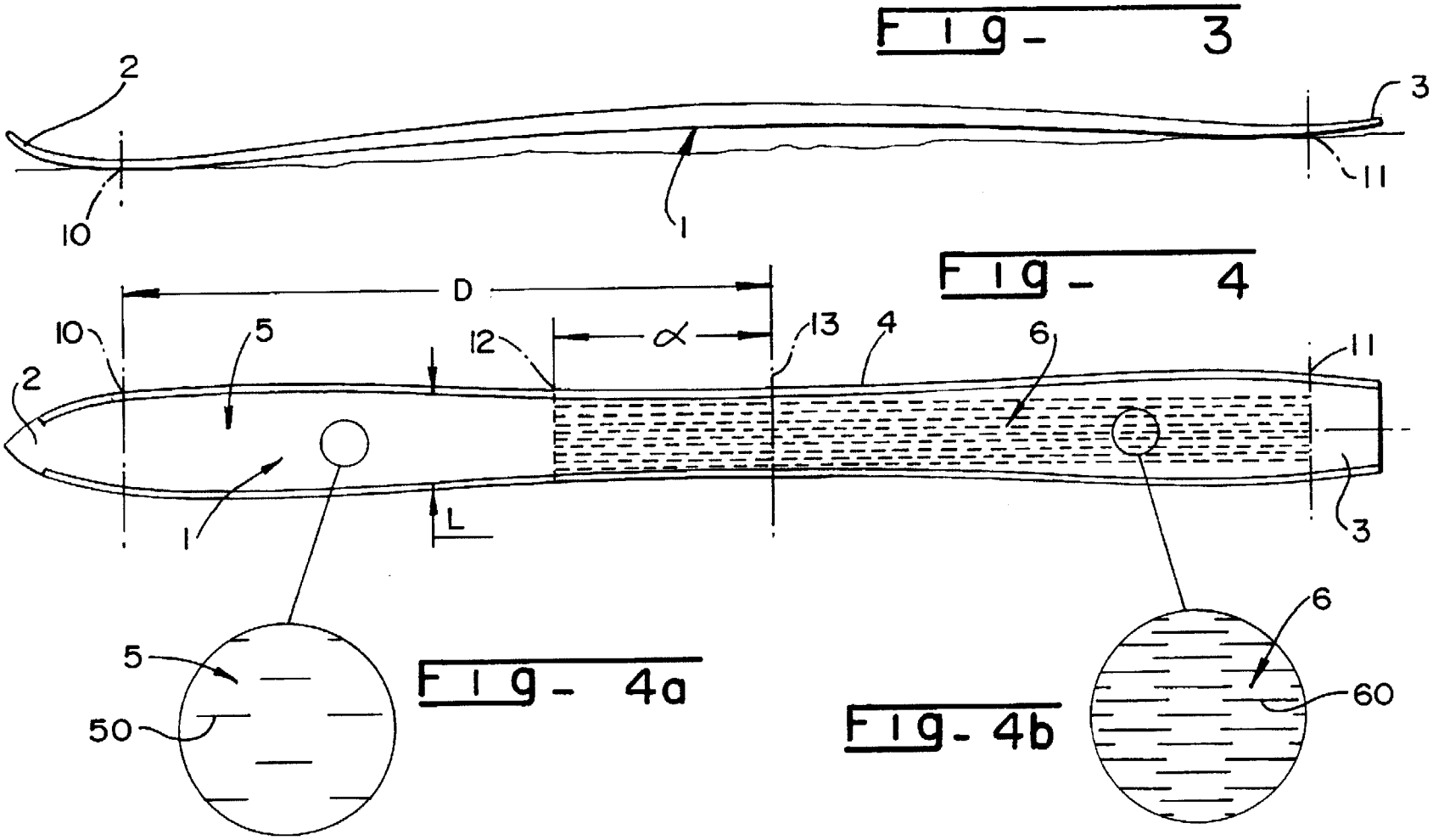
FIG. 3 shows a ski as per the invention in a side view when such ski does not bear a load.
FIG. 4 shows the ski of FIG. 3 in a bottom view.
FIGS. 4*a* and 4*b* are detailed views of the sole as shown in FIG. 4.

The example of FIG. 3 illustrates a slightly cambered alpine ski whose gliding sole or lower surface 1 rests on a front contact line 10 and a rear contact line 11. The surface comprised between these two lines 10, 11 meets the snow due to the weight of the skier, and becomes the bearing surface of the ski (FIG. 1). The ski comprises a portion raised in a shovel 2 and another in a tail 3.

FIG. 4 illustrates sole 1, preferably made of polyethylene, having a width L, bordered on each side by metallic side running edges 4. The sole comprises a lightly serrated front portion 5 and a strongly serrated rear portion 6.

The rear portion 6 is demarcated, on the one hand, by rear contact line 11 and on the other hand, by a line 12 located at a distance d, in front of the virtual line 13 representing the center position of the boot as indicated by the manufacturer. At any rate, distance d cannot exceed 0.4 times the distance D separating the boot center line 13 from the forward contact line 10.

Front portion 5 is adjacent to rear portion 6 and extends towards the front thereof, from line 12 up to forward contact line 10.

FIG. 4*b* shows, in an enlarged view, an example of the structuring of the rear portion 6 as per the invention. It could consist of a multitude of short, rectilinear serrations 60 that are discontinuous and arranged in rows meshed into one another.

In front portion 5 the structuring is more superficial and serrations 50 are more spaced, shorter, less deep and less wide than those in the rear portion (FIG. 4*a*).

The structuring can also be quasi non-existent and this portion can have a surface that is as smooth as possible.

In snow trials, the Applicants noted that the following surface characteristics of the rear portion led to satisfactory results on snow:

serration depth: comprised between 0.02 mm and 0.08 mm;

serration length: comprised between 10 mm and 60 mm;

serration width: comprised between 0.1 mm and 0.3 mm;

design: meshed rows;

Rtm coefficient: comprised between 20 μm and 80 μm;

Rku coefficient: comprised between 5 and 35.

Figure 5:
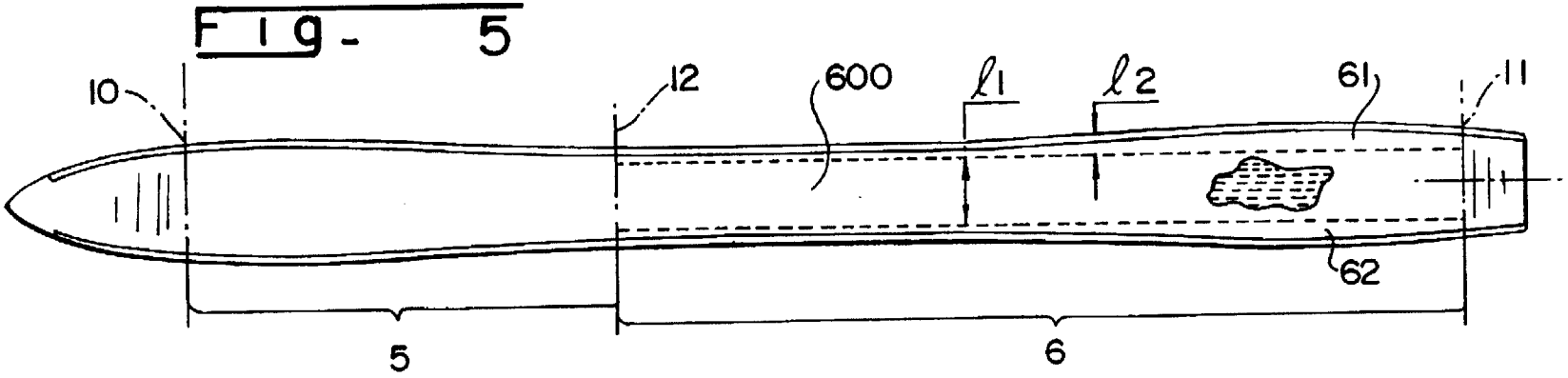
FIG. 5 is a view similar to FIG. 4 as per a variation.

FIG. 5 illustrates a variation of the invention wherein rear portion 6 comprises a strongly structured central zone 600 having a width l1 and, on both sides of said zone, side edges 61, 62 having a width l2, that are smooth or lightly structured.

Central zone 600 has a width l2 that is constant over the entire length of rear portion 6. The side edges 61, 62 constitute the curved gliding surfaces of the ski where a strong pressure is exerted. Too much structuring in these zones could play to the detriment of the pivoting properties of the ski. According to the invention, width l2 of each edge 61, 62 is comprised between 0.03 L and 0.3 L. At any rate, width l1 of the central zone is always greater than or equal to 0.45×L.

Figure 6:
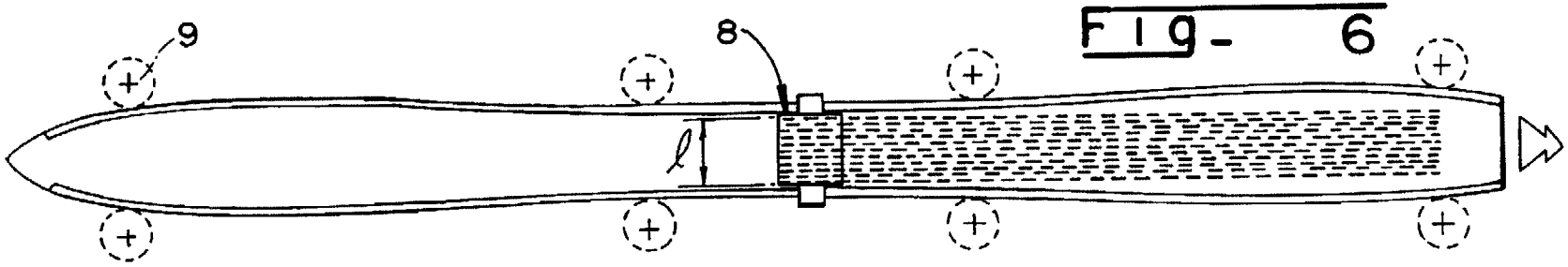
FIGS. 6 and 7 show an embodiment of the structuring of the sole of the ski of FIG. 5.
Figure 7:
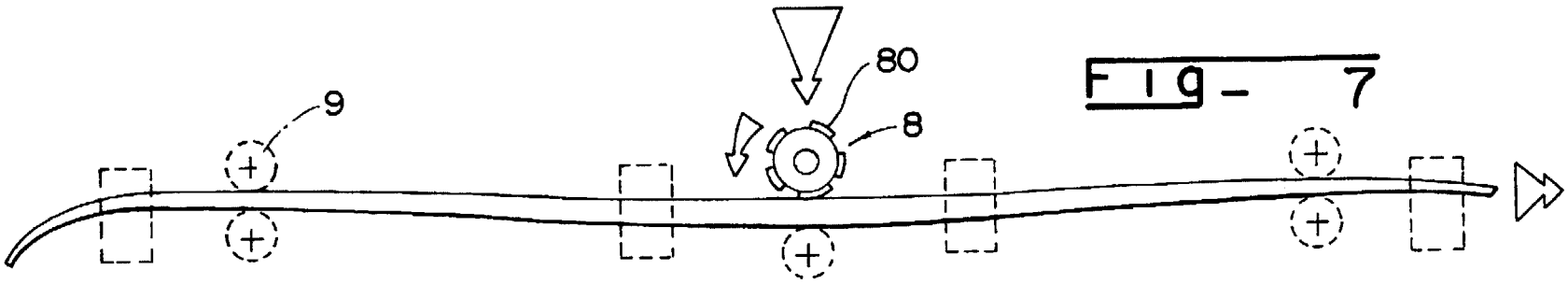

FIGS. 6 and 7 illustrate an advantageous example enabling a structuring of the sole of a ski as per the invention to be obtained, and more particularly in the case where one wants to obtain a constant width l1 for central zone 600 of the lower surface conferring a variable width l2 for the side edges 61, 62.

For this, a device comprising a heated tool 8 is used, said tool having the shape of a roller that has a raised design on its surface of a constant edge width l, comprising a plurality of discontinuous ribs 80. The surface of the roller is applied, under pressure, against the surface of sole 1 of the ski to be prepared, by undertaking a longitudinal run of the ski between several guide plates 9. It can also be provided that the ski remains immobile and the tool moves with respect to the ski, as an entirely equivalent means. According to the nature of the material constituting the sole and the dimensions of the serrations to be obtained the pressure and temperature conditions can be adapted without any special difficulties, so as to obtain satisfactory and reproducible results. Thus, the gliding surface of the ski, according to the aforementioned description, is provided with such serrations by means of the ribs of the tool used, i.e., the ribs form depressions or scores within the sole or gliding surface of the ski.

As a non-limiting example, for a sole of the high density polyethylene type and in case the serrations are obtained as per the aforementioned characteristics provided as examples, it is preferable to work at a temperature between 80° and 120° C., and to exert pressure on the surface of the sole by the revolving tool 8.

In such a method, it is not necessary to undertake several passes of the tool over the surface. On the other hand, however, it is not forbidden to rework the surface by a finishing process enabling micro-structuring over the entire sole, for example, by using techniques that are well known to a person skilled in the art, as for example, by stone polishing, for example.

By means of the structuring of the sole of the ski of the invention, serrations 50 or 60, e.g., are formed in the lower gliding surface 4, in a manner which serves to resolve the problems mentioned above with regard to known skid. Even with the serrations formed therein, the profile of the lower gliding surface 4 remains substantially flat or continous as seen in the side view of FIG. 3, for example.

Figure 8:
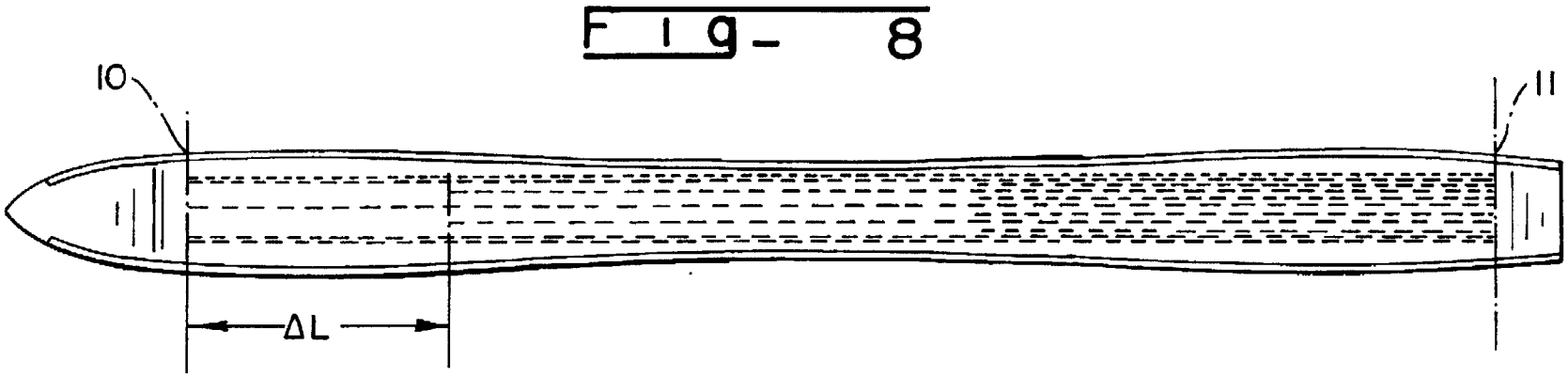
FIG. 8 illustrates another variation of the invention.

In the case of FIG. 8, the structuring has such a roughness gradient that the measured parameters Rtm and Rku decrease progressively, from the rear contact line 11 towards the forward contact line 10. This gradient can be obtained, for example, by progressively reducing the number of serrations and their dimensions (length, width and depth), from rear line 11 towards forward line 10.

It can be provided that on certain short portions of length ΔL of the lower surface, values Rtm and Rku can remain substantially constant. Thus, it can advantageously be provided that the increasing progression of values Rtm and Rku be done by stages, i.e., by a succession of short, adjacent portions in which values Rtm and Rku are substantially constant, but vary from one adjacent portion to the other.

Figure 9:
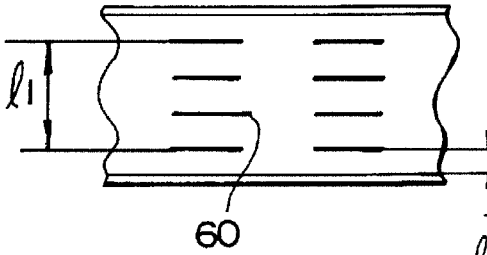
FIGS. 9 through 11 are detailed views of various examples of the structuring as per the invention.
Figure 10:
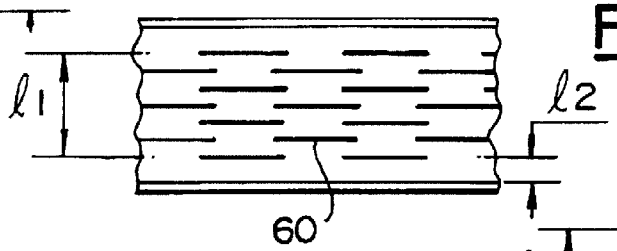
Figure 11:
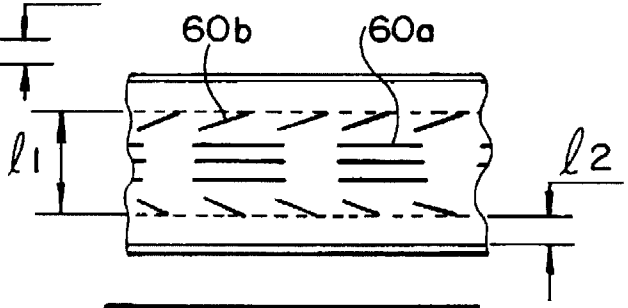

FIGS. 9 through 11 represent non-limiting examples of the positioning of the serrations on the gliding surface as per the invention. Among the serrations equipping the surface, one can have:

serrations 60 that are parallel and arranged in separate rows, oriented longitudinally (FIG. 9);

parallel, meshed serrations oriented longitudinally (FIG. 10);

parallel serrations oriented longitudinally 60*a* and others that are inclined 60*b* (FIG. 11).

The length of the serrations can vary, generally between 4 mm and 50 mm, according to the type of snow and type of ski used.

The coating used to constitute the sole of the ski is selected from among sintered or extruded polyethylenes. The polyethylene can contain a more or less substantial graphite filler (generally around 15% approximately).

According to the invention, the sole of the ski can be constituted by a single material.

The instant application is based upon French patent application 93.15019 of Dec. 9, 1993, the disclosure of which is hereby expressly incorporated by reference thereto, and the priority of which is hereby claimed.

Naturally, the invention is not limited to the embodiments described and represented hereinabove, but can also comprise all technical equivalents thereof as well as their combinations that can be included within the scope of the following claims.

What is claimed is:

1. A snow ski comprising:

a lower gliding surface having a substantially flat profile;

said gliding surface comprises a front contact line and a rear contact line, a front portion and a rear portion;

said rear portion of said gliding surface extending rearwardly to said rear contact line from a transverse line located between a boot center line and a distance forward of the boot center line equal to 0.4 times a distance separating said boot center line from said front contact line;

said front portion of said gliding surface extending forwardly to said front contact line from said transverse line; and said front portion of said gliding surface comprising a structured surface, including a smooth or lightly structured surface, and said rear portion of said gliding surface comprising a structured surface, including a strongly structured surface, said strongly structured surface of said rear portion of said gliding surface having a measured roughness parameter value Rtm greater than a measured roughness parameter value Rtm of any portion of said structured surface of said front portion of said gliding surface.

2. A snow ski according to claim 1, wherein:

said measured roughness parameter value Rtm of said front portion of said gliding surface is less than or equal to 15 μm and said measured roughness parameter value Rtm of said rear portion of said gliding surface is greater than 15 μm.

3. A snow ski according to claim 1, wherein:

said strongly structured surface of said rear portion of said gliding surface extends rearwardly at least to said rear contact line.

4. A snow ski according to claim 1, wherein:

said strongly structured surface of said rear portion of said gliding surface extends rearwardly from a line located at a distance between 0.2 and 0.4 times a distance separating said boot center line from said front contact line.

5. A snow ski according to claim 1, wherein:

said strongly structured surface of said rear portion of said gliding surface has a roughness parameter value Rtm greater than 15 μm over a central width zone of said gliding surface, said central width zone having on opposite sides edge zones, each of said edge zones comprising a smooth or lightly structured surface and having a roughness parameter value Rtm less than 15 μm and a roughness parameter value Rku less than 3.

6. A snow ski according to claim 5, wherein:

said gliding surface comprises a width equal to widths of said central width zone and each of said edge zones;

each of said edge zones has a width between 0.03 and 0.3 of said width of said gliding surface; and said central width zone has a width at least 0.45 of said width of said gliding surface.

7. A snow ski according to claim 1, wherein:

said strongly structured surface of said rear portion of said gliding surface has a constant width.

8. A snow ski according to claim 7, made by a method comprising:

applying a heat and pressure to said rear portion of said gliding surface by means of a roller engaging said rear portion of said gliding surface, said roller having constant width and a surface having a raised design, said raised design comprising a plurality of discontinuous ribs.

9. A snow ski according to claim 1, wherein:

said strongly structured surface of said rear portion of said gliding surface comprises a plurality of short, rectilinear and discontinuous serrations arranged in separate rows.

10. A snow ski according to claim 1, wherein:

said strongly structured surface of said rear portion of said gliding surface comprises a plurality of short, rectilinear and discontinuous serrations arranged in meshed rows.

11. A snow ski according to claim 9, wherein:

a majority of said serrations are oriented along a longitudinal axis of the ski.

12. A snow ski according to claim 10, wherein:

a majority of said serrations are oriented along a longitudinal axis of the ski.

13. A snow ski according to claim 1, wherein:

said strongly structured surface of said rear portion of said gliding surface has a roughness gradient, whereby said roughness parameter value Rtm and a roughness parameter value Rku decrease progressively in a direction from said rear contact line toward said front contact line.

14. A snow ski according to claim 1, wherein:

said strongly structured surface of said rear portion of said gliding surface has a roughness gradient, whereby said roughness parameter value Rtm and a roughness parameter value Rku decrease progressively in a transverse direction from side edges towards a longitudinal median axis over a majority of a width of said gliding surface, whereby said roughness parameter value Rtm and a roughness parameter value Rku are substantially constant over small width portions.

15. A snow ski according to claim 1, wherein:

said lower gliding surface has a predetermined length; and said lower gliding surface is constituted by a coating having a common chemical property and hardness along said predetermined length.

16. A snow ski according to claim 1, wherein:

said ski is a downhill ski.

17. A snow ski according to claim 16, wherein:

said downhill ski is one of an alpine ski, monoski and a snowboard.

18. A snow ski according to claim 1, wherein:

longitudinally between said front contact line and said rear contact line, said lower gliding surface consists of said smooth or lightly structured surface of said front portion and said strongly structured surface of said rear portion.

19. A snow ski according to claim 1, wherein:

said structured surface of said front portion of said gliding surface and said structured surface of said rear portion are constituted by serrations consisting of depressions within said gliding surface.

20. A snow ski according to claim 1, further comprising:

a pair of running edges on either side of said gliding surface.

21. A snow ski comprising:

a lower gliding surface;

said gliding surface comprises a front contact line and a rear contact line, a front portion and a rear portion;

said rear portion of said gliding surface extending rearwardly to said rear contact line from a transverse line located between a boot center line and a distance forward of the boot center line equal to 0.4 times a distance separating said boot center line from said front contact line;

said front portion of said gliding surface extending forwardly to said front contact line from said transverse line; and said front portion of said gliding surface comprising a structured surface, including a lightly structured surface comprising a plurality of rectilinear and discontinuous serrations;

said rear portion of said gliding surface comprising a structured surface, including a strongly structured surface, said strongly structured surface of said rear portion of said gliding surface having a measured roughness parameter value Rtm greater than a measured roughness parameter value Rtm of any portion of said structured surface of said front portion of said gliding surface, and said strongly structured surface of said rear portion of said gliding surface comprising a plurality of rectilinear and discontinuous serrations.

22. A snow ski according to claim 21, wherein:

said measured roughness parameter value Rtm of said front portion of said gliding surface is less than or equal to 15 μm and said measured roughness parameter value Rtm of said rear portion of said gliding surface is greater than 15 μm.

23. A snow ski according to claim 21, wherein:

said strongly structured surface of said rear portion of said gliding surface extends rearwardly at least to said rear contact line.

24. A snow ski according to claim 21, wherein:

said strongly structured surface of said rear portion of said gliding surface extends rearwardly from a line located at a distance between 0.2 and 0.4 times a distance separating said boot center line from said front contact line.

25. A snow ski according to claim 21, wherein:

said strongly structured surface of said rear portion of said gliding surface has a roughness parameter value Rtm greater than 15 μm over a central width zone of said gliding surface, said central width zone having on opposite sides edge zones, each of said edge zones comprising a lightly structured surface and having a roughness parameter value Rtm less than 15 μm and a roughness parameter value Rku less than 3.

26. A snow ski according to claim 25, wherein:

said gliding surface comprises a width equal to widths of said central width zone and each of said edge zones;

each of said edge zones has a width between 0.03 and 0.3 of said width of said gliding surface; and said central width zone has a width at least 0.45 of said width of said gliding surface.

27. A snow ski according to claim 21, wherein:

said strongly structured surface of said rear portion of said gliding surface has a constant width.

28. A snow ski according to claim 27, made by a method comprising:

applying a heat and pressure to said rear portion of said gliding surface by means of a roller engaging said rear portion of said gliding surface, said roller having constant width and a surface having a raised design, said raised design comprising a plurality of discontinuous ribs.

29. A snow ski according to claim 21, wherein:

said serrations include serrations arranged in a plurality of parallel transversely extending rows.

30. A snow ski according to claim 29, wherein:

said serrations arranged in rows are longitudinally extending short serrations.

31. A snow ski according to claim 21, wherein:

said serrations include serrations arranged in a plurality of meshed transversely extending rows.

32. A snow ski according to claim 29, wherein:

said serrations arranged in rows are longitudinally extending short serrations.

33. A snow ski according to claim 21, wherein:

said strongly structured surface of said rear portion of said gliding surface has a roughness gradient, whereby said roughness parameter value Rtm and a roughness parameter value Rku decrease progressively in a direction from said rear contact line toward said front contact line.

34. A snow ski according to claim 21, wherein:

said strongly structured surface of said rear portion of said gliding surface has a roughness gradient, whereby said roughness parameter value Rtm and a roughness parameter value Rku decrease progressively in a transverse direction from side edges towards a longitudinal median axis over a majority of a width of said gliding surface, whereby said roughness parameter value Rtm and a roughness parameter value Rku are substantially constant over small width portions.

35. A snow ski according to claim 21, wherein:

said lower gliding surface has a predetermined length; and said lower gliding surface is constituted by a coating having a common chemical property and hardness along said predetermined length.

36. A snow ski according to claim 21, wherein:

said ski is a downhill ski.

37. A snow ski according to claim 36, wherein:

said downhill ski is one of an alpine ski, a monoski and a snowboard.

38. A snow ski according to claim 21, wherein:

longitudinally between said front contact line and said rear contact line, said lower gliding surface consists of said lightly structured surface of said front portion and said strongly structured surface of said rear portion.

39. A snow ski according to claim 21, wherein:

said gliding surface has a substantially continuous profile.

40. A snow ski according to claim 21, wherein:

said serrations are constituted by depressions within said gliding surface.

41. A snow ski according to claim 21, further comprising:

a pair of running edges on either side of said gliding surface.

42. A snow ski comprising:

a lower gliding surface;

said gliding surface comprises a front contact line and a rear contact line, a front portion and a rear portion;

said rear portion of said gliding surface extending rearwardly to said rear contact line from a transverse line located between a boot center line and a distance forward of the boot center line equal to 0.4 times a distance separating said boot center line from said front contact line;

said front portion of said gliding surface extending forwardly to said front contact line from said transverse line; and said front portion of said gliding surface comprising a structured surface, including a lightly structured surface;

said rear portion of said gliding surface comprising a structured surface, including a strongly structured surface, said strongly structured surface of said rear portion of said gliding surface having a measured roughness parameter value Rtm greater than a measured roughness parameter value Rtm of any portion of said structured surface of said front portion of said gliding surface;

wherein each of said lightly structured surface of said front portion of said gliding surface and said strongly structured surface of said gliding surface comprises means for facilitating sliding of said ski.

* * * * *